United States Patent [19]

Gatzke

[11] 4,210,717

[45] Jul. 1, 1980

[54] HALF SOAP FORMATION FOR PHOTOTHERMOGRAPHIC EMULSIONS

[75] Inventor: Kenneth G. Gatzke, Lake Elmo, Minn.

[73] Assignee: Minnesota Mining and Manufacturing Company, Saint Paul, Minn.

[21] Appl. No.: 970,264

[22] Filed: Dec. 18, 1978

[51] Int. Cl.[2] ..... G03C 1/02

[52] U.S. Cl. ..... 430/620; 430/353

[58] Field of Search ..... 96/114, 94 R, 67, 66 T; 260/413 R, 413 HC, 417, 418

[56] References Cited

U.S. PATENT DOCUMENTS

| | | | |
|---|---|---|---|
| 3,839,049 | 10/1974 | Simons | 96/114.1 |
| 4,039,334 | 8/1977 | Ikenque et al. | 96/114.1 |
| 4,123,274 | 10/1978 | Knight et al. | 96/66 T |
| 4,124,387 | 11/1978 | Kohrt | 96/114.1 |

*Primary Examiner*—J. Travis Brown

*Attorney, Agent, or Firm*—Cruzan Alexander; Donald M. Sell; Mark A. Litman

[57] ABSTRACT

Half soaps of organic acids and silver salts of the organic acids are formed by converting alkali metal or ammonia salts of the organic acid to the silver salt of the acid at a pH of less than 9.0 to improve the conversion percentage and improve the general quality of the half soap.

6 Claims, No Drawings

HALF SOAP FORMATION FOR PHOTOTHERMOGRAPHIC EMULSIONS

FIELD OF THE INVENTION

The present invention relates to half soaps of organic silver salts and organic acids, usually containing from 25 to 80 weight percent of the silver salt. These half soaps are used in the formation of photothermographic emulsions.

PRIOR ART BACKGROUND

In the manufacture of dry silver emulsions, it is generally preferred to work with half soap emulsions. These are emulsions which constitute less than 100% by weight of the silver salt of an organic acid, and the remainder up to 100% being constituted by the organic acid. In the conversion of an organic acid to a full soap (100% silver salt of the acid), the solubility of the composition changes, and different solvents or conditions must be used to keep the material in solution or wetted by the solution. This change in solvent requirements often occurs at about 90% conversion of an alkali or ammonia salt of the acid to the silver salt of the acid.

U.S. Pat. Nos. 3,839,049 and 3,761,273 disclose the use of preformed silver halides in the formation of dry silver emulsions and elements. In these references, significant loss of silver (greater than 10% loss) is noted in the conversion to the silver salt. High pH solutions are used in U.S. Pat. No. 3,761,273 which tend to form silver hydroxide which contributes to silver loss and emulsion inefficiency. When silver halide is added or formed in such high pH solutions, as in the teachings of the above-identified patents, a black precipitate of silver hydroxide tends to form, reducing the performance of the dry silver emulsion.

U.S. Pat. No. 3,839,049 lowers the temperature of solutions containing the alkali metal or ammonia salts of the acid so as to produce colloidal dispersions in an effort to control particle size of the finished emulsion. This causes increased viscosity making the dispersion difficult to work with and contributes to the loss of silver in the process which (in the form of silver nitrate) cannot react with the behenic acid salt in the interior of the dispersed particles.

U.S. patent application Ser. No. 803,549, filed June 6, 1977, also discloses a process for forming photothermographic emulsions with preformed or coprecipitated silver halide crystals. The process disclosed therein also allows the pH of the dispersion to rise above 9.0 when converting the alkali metal or ammonia salt of the organic acid to a silver salt in the presence of silver halide. This also reduces the yield of the silver salt and reduces the purity of the emulsion by forming silver hydroxide during the process.

SUMMARY OF THE INVENTION

In the practice of the present invention it has been found that if the organic acid (preferably a long chain fatty acid) is converted to a sodium salt and then converted to silver salt at a pH less than 9, and if the conversion of the alkali metal salt or ammonia salt to a silver salt in the formation of half soaps occurs above 70° C. and especially between 80° and 100° C. (keeping the sodium behenate and behenate melt in solution so that even size distribution of the particles is maintained), there is a significant reduction of silver loss in the formation of half soap emulsions.

A step-wise description of the present invention is outlined below:

(1) melt organic acid in water;

(2) convert 30–80% of acid to alkali metal or ammonia salt of pH of less than 9;

(3) precipitate or add silver halide dispersion into behenic acid salt solution which is maintained at a temperature sufficient to keep the organic acid salt melted or dispersed;

(4) introduce silver nitrate to convert alkali metal organic acid to silver salt of the organic acid at elevated temperature;

(5) cool to room temperature, filter, wash and dry.

Steps 2 and 3 may be reversed in the above procedure, and, in fact, it is preferred to form the silver halide first to provide nucleation sites and maintain a more moderate viscosity during conversion of acid to salt.

The benefits of this process further include the greater ease in obtaining fine precipitates that can be redispersed, and the ability to use high concentration dispersions or solutions which maintain an acceptably low viscosity so that they may be stirred during the manufacturing process.

The invention will be further described by the following examples.

EXAMPLE 1

150 grams of behenic acid was added to 1600 milliliters of distilled water at 85° C. After the acid has melted, 9.17 grams of NaOH in 100 mls of water was added slowly with mixing to convert approximately 50% of the behenic acid to sodium behenate. The pH of the solution was 8.7.

3 grams of preformed silver iodobromide grains in 3 grams of gelatin was melted in 50 milliliters of water and added to the previous solution. 38.50 grams of silver nitrate dissolved in 250 milliliters of water at 85° C. was added dropwise to the solution over a period of thirty minutes. The resulting suspension had a pH of about 4 and a pAg between 3 and 4 and was then cooled to room temperature and filtered over suction. The filtrate was reslurried twice in two liters of distilled water than filtered and dried for seven days at 32° C. 99.85% of the silver was converted to silver behenate, so there was a loss of only 0.15% by weight of the silver. This compares to the 11% loss noted in U.S. Pat. No. 3,839,049 (column 3, lines 54–59).

The final dried precipitate was then dispersed at 16% solids in acetone in two passes in an homogenizer at 4000 and 8000 p.s.i. This was then mixed with toluene (to dilute to 11% solids), 0.06% by weight polyvinylbutyral, and 29 milliliters of a 10% by weight solution of $HgBr_2$ in methanol. An additional 13% by weight of polyvinylbutyral, 57 milliliters of $HgBr_2$ in methanol, 2.6% by weight 2,2'-methylene-bis-(4-methyl-6-tertiary butyl phenol) developer and 6.3% by weight of a 0.005% by weight solution of sensitizing dye in methanol were added. This solution was coated at 3.5 mils thickness on photographic paper and dried for 3 minutes at 78° C. The dye has the structure:

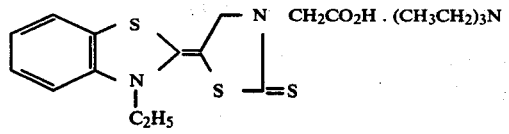

A topcoat having the following composition was applied at the same thickness and dried in the same manner:

| Percent | Ingredient |
|---|---|
| 62.35 | acetone |
| 15.0 | methylethylketone |
| 9.5 | methanol |
| 8.0 | 10% silica in acetone |
| 4.1 | cellulose acetate |
| 0.06 | tetrachlorophthalic anhydride |
| 0.15 | tetrachlorophthalic acid |
| 0.34 | 4-methylphthalic acid |
| 0.50 | phthalizine |

The resulting sheet proved to be a high quality photothermographic element.

Long chain fatty acids as used in the practice of the present invention are long chain ($C_8$–$C_{28}$) alkyl groups with a terminal carboxylic acid group. More than one acid may be present, and $C_{14}$–$C_{24}$ acids are preferred. Systems comprising at least 40% by weight of behenic acid are most preferred.

Any light sensitive silver halide salt may be used in the emulsion, the selection being made on the basis of the sensitometric properties desired. Silver chloride, silver bromide, silver bromoiodide, silver chlorobromoiodide emulsions and other combinations of the halides may be used. These grains may be chemically sensitized with metal salts and sulfur containing compounds.

What is claimed is:

1. In the process of forming a photothermographic emulsion by converting in solution, suspension, or dispersion 25 to 80% by weight of an organic acid, comprising an alkyl group of 8 to 28 carbon atoms with a terminal carboxylic acid group, to an alkali metal or ammonia salt of said acid and then converting in solution or suspension the salt to a silver salt of the organic acid, with silver halide being present during either the conversion of the acid to a salt or the conversion of the salt to a silver salt of the organic acid, the improvement which comprises maintaining the solutions, suspensions, or dispersions at a pH of more than 9 and a temperature of at least 70° C. when the acid is converted to an alkali metal or ammonia salt and when the alkali metal or ammonia salt is converted to a silver salt.

2. The process of claim 1 wherein the silver halide is present in the solution, suspension, or dispersion only during the conversion of the alkali metal or ammonia salt of the organic acid to a silver salt of the organic acid.

3. The process of claim 1 wherein the silver halide is present in the solution, suspension, or dispersion during the conversion of the organic acid to an alkali metal or ammonia salt.

4. The process of claim 1 wherein said organic acid comprises at least 40% by weight of behenic acid.

5. The process of claim 2 wherein said organic acid comprises at least 40% by weight of behenic acid.

6. The process of claim 3 wherein said organic acid comprises at least 40% by weight of behenic acid.

* * * * *

UNITED STATES PATENT AND TRADEMARK OFFICE

CERTIFICATE OF CORRECTION

PATENT NO. : 4,210,717

DATED : July 1, 1980

INVENTOR(S) : Kenneth G. Gatzke

It is certified that error appears in the above—identified patent and that said Letters Patent is hereby corrected as shown below:

Col. 4, l. 15: "at a pH of more than 9" should read --at a pH of no more than 9--

Signed and Sealed this

First Day of February 1983

[SEAL]

*Attest:*

GERALD J. MOSSINGHOFF

*Attesting Officer*

*Commissioner of Patents and Trademarks*